US007635288B2

(12) United States Patent
Kawata

(10) Patent No.: US 7,635,288 B2
(45) Date of Patent: Dec. 22, 2009

(54) ANIMATED HAND PUPPET & ANIMATOR THEREFOR

(75) Inventor: Erica Kawata, Emeryville, CA (US)

(73) Assignee: Folkmanis, Inc., Emeryville, CA (US)

( * ) Notice: Subject to any disclaimer, the term of this patent is extended or adjusted under 35 U.S.C. 154(b) by 340 days.

(21) Appl. No.: 11/347,462

(22) Filed: Feb. 3, 2006

(65) Prior Publication Data

US 2007/0184751 A1 Aug. 9, 2007

(51) Int. Cl.
*A63H 3/14* (2006.01)

(52) U.S. Cl. ..... 446/327; 446/330; 446/339

(58) Field of Classification Search ..... 446/268, 446/327, 328, 329, 330, 331, 337, 338, 339
See application file for complete search history.

(56) References Cited

U.S. PATENT DOCUMENTS 1,648,411 A * 11/1927 Felix ..... 446/329
2,551,195 A * 5/1951 Wirth ..... 446/327
2,771,708 A * 11/1956 Enison ..... 446/367
3,162,214 A * 12/1964 Bazinet Jr ..... 138/120
3,557,780 A * 1/1971 Sato ..... 600/141
4,457,097 A * 7/1984 Miller et al. ..... 446/327
4,695,265 A * 9/1987 Clark ..... 446/329
5,167,221 A * 12/1992 Chikama ..... 600/149
5,276,934 A * 1/1994 Brzoska ..... 15/104.33
5,489,270 A * 2/1996 van Erp ..... 604/95.04
6,858,005 B2 * 2/2005 Ohline et al. ..... 600/141

* cited by examiner

*Primary Examiner*—John Ricci
(74) *Attorney, Agent, or Firm*—H. Michael Brucker

(57) ABSTRACT

A soft sculpture puppet and a pliable animator therefor which is in the form of an elongated member that is inserted in an appendage of the puppet in a position accessible to the hand of a puppeteer and which includes controls that can be manipulated to cause the animator to curve and bend and thereby move the appendage.

36 Claims, 15 Drawing Sheets

ANIMATED HAND PUPPET & ANIMATOR THEREFOR

FIELD OF THE INVENTION

The present invention relates to hand puppets, and, more particularly, to hand puppets of the soft sculpture variety equipped with an internal animator that produces life-like movement of various appendages.

BACKGROUND

Hand puppets featuring a chamber for receiving a human hand and appendages that can be manipulated by the inserted hand and/or its fingers have delighted children of all ages for many decades. Frequently, such puppets are in the form of animals and the chamber is situated to permit the fingers of a hand to work such parts as the mouth, arms, legs, wings and/or head, whereupon the puppet can be made to appear to come to life.

What has not been achieved with such puppets, prior to the present invention, is a way of using the inserted hand to give life-like movement to long narrow appendages, such as a neck (swans, flamingos, giraffes, etc.), an elephant's trunk, or the like, when the passages are too small to allow the insertion of a hand and too long to be worked by a finger.

BRIEF DESCRIPTION OF THE INVENTION

In order to be able to produce life-like animation to the head and neck of a swan, or trunk of an elephant, or other long narrow appendage of a soft sculpture hand puppet, the present invention provides a flexible, elongated animator having a base section, an elongated body section terminating in a tip end, a top side and a generally parallel bottom side. A first control strap extends along the top side of the animator from its base section to the tip end. A second control strap extends along the top side of the base section, and then through the base section and along the bottom side to the tip end. Pulling one strap causes the animator to bend in one direction; pulling the other strap causes the animator to bend in an opposite direction; pulling both straps causes the animator to form a curve having a shape depending on the animator's construction.

A ring is attached to the end of each control strap by which the straps are pulled by fingers inserted into the puppet body chamber. In this way, a hand in the body chamber can insert a finger in each ring and pull the control straps in combinations that produce life-like motion of the long narrow appendage in which the animator is affixed. A one strap, one ring embodiment is also disclosed.

The structure of the body of the animator allows for variations which produce particular bending curves that most nearly emulate the actual movement of the animal appendage being vitalized.

So as not to change the soft and cuddly character of the soft sculpture puppets, the animator of the invention is made from soft and pliable materials.

Accordingly, it is an object of the present invention to provide a soft sculpture hand puppet having a long narrow appendage that can be hand animated.

It is another object of the invention to provide an animator which can be incorporated into a soft sculpture hand puppet having a long narrow appendage so that the appendage can be animated.

Yet another object of the present invention is to provide an animator for a soft sculpture hand puppet that is soft and pliable.

The foregoing and other objectives, features and advantages of the invention will be more readily understood upon consideration of the following detailed description of the invention taken in conjunction with the accompanying drawings.

DETAILED DESCRIPTION OF THE INVENTION

Figure 1:
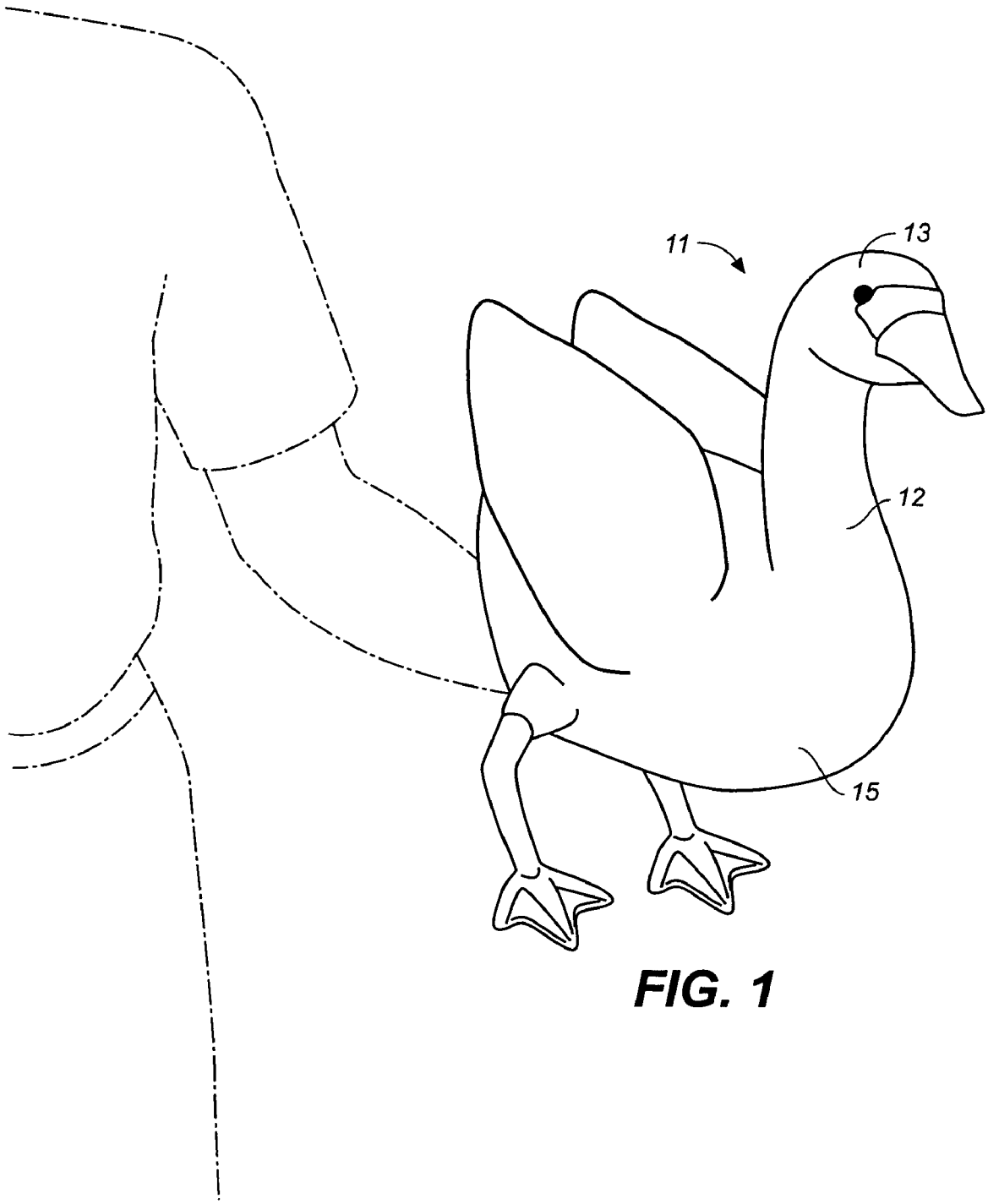
FIG. 1 is a perspective view of a soft sculpture puppet of the present invention in the form of a swan.
Figure 2:
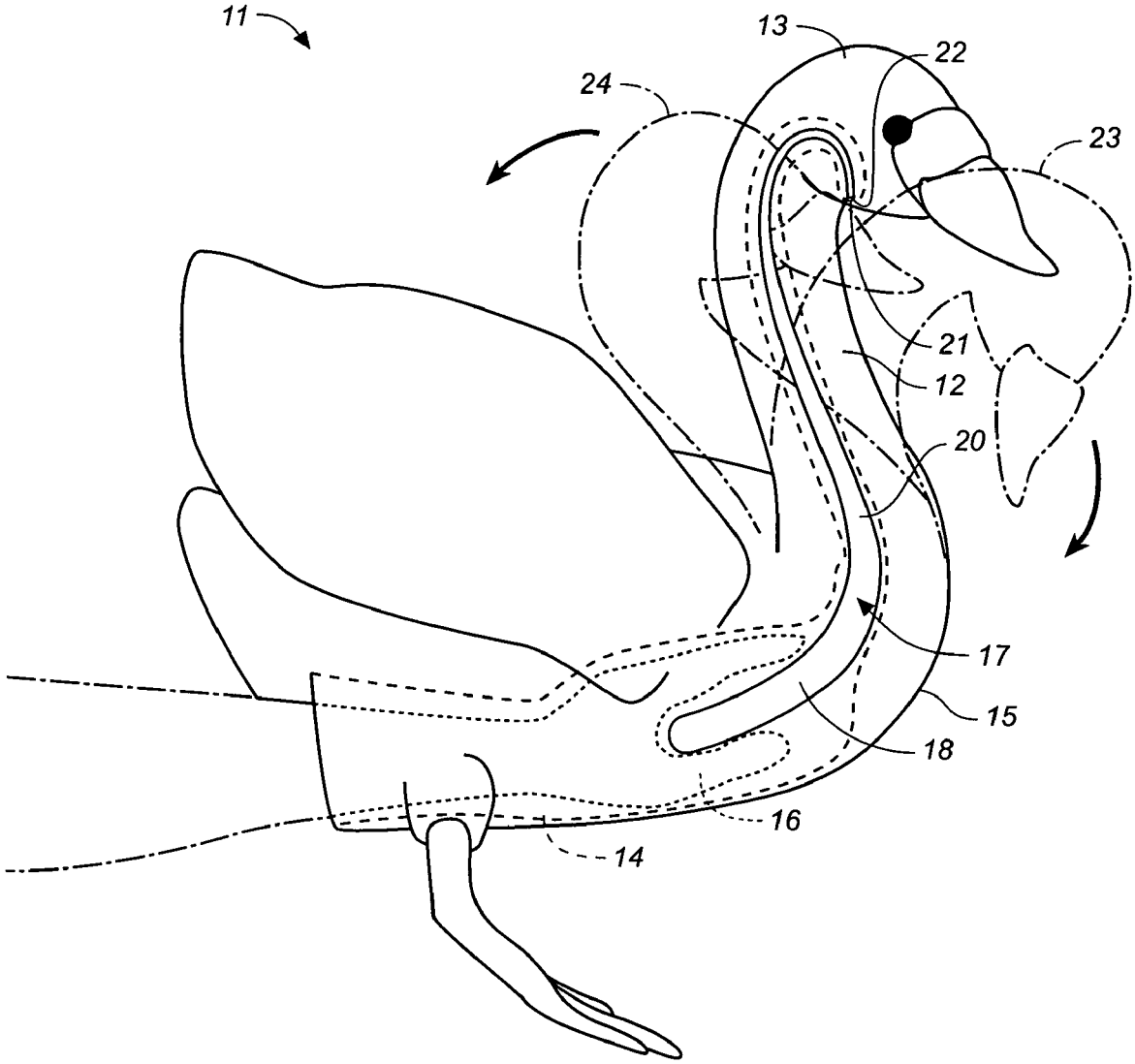
FIG. 2 is a side view of the swan of FIG. 1 with certain internal parts revealed in relationship to a user's hand and with the range of animated positions illustrated.

Referring to FIGS. 1 and 2, a soft sculpture puppet 11 in the form of a swan having a body 15 and an elongated neck 12 supporting a head 13. A chamber 14 within the puppet 11 is sized to receive a human hand 16 which animates the puppet 11. In order to animate the neck 12 and head 13, both of which are too small to receive the hand 16, an animator 17 of the present invention is affixed within puppet 11 to extend from the chamber 14, where it is accessible to the hand 16, through the neck 12 to the head 13.

Animator 17 has a base section 18 disposed in the internal chamber 14 where it can be grasped by the hand 16, and a flexible body section 20 that extends from the base section 18 through the neck 12 to the head 13 where it terminates in tip end 22 which is attached at 21.

As more fully described below, the animator 17 includes a hand-operated mechanism (not shown) by which the body section 20 can be made to selectively bend in opposing directions, causing the neck 12 and head 13 to make life-like movements between the positions illustrated by dashed lines 23 and 24. One of the outstanding features of the invention is that the animator 17 does not merely cause the neck 12 and head 13 to move back and forth, but also causes the neck 12 to curve as it moves forward or backward, making the movements more life-like.

Figure 3:
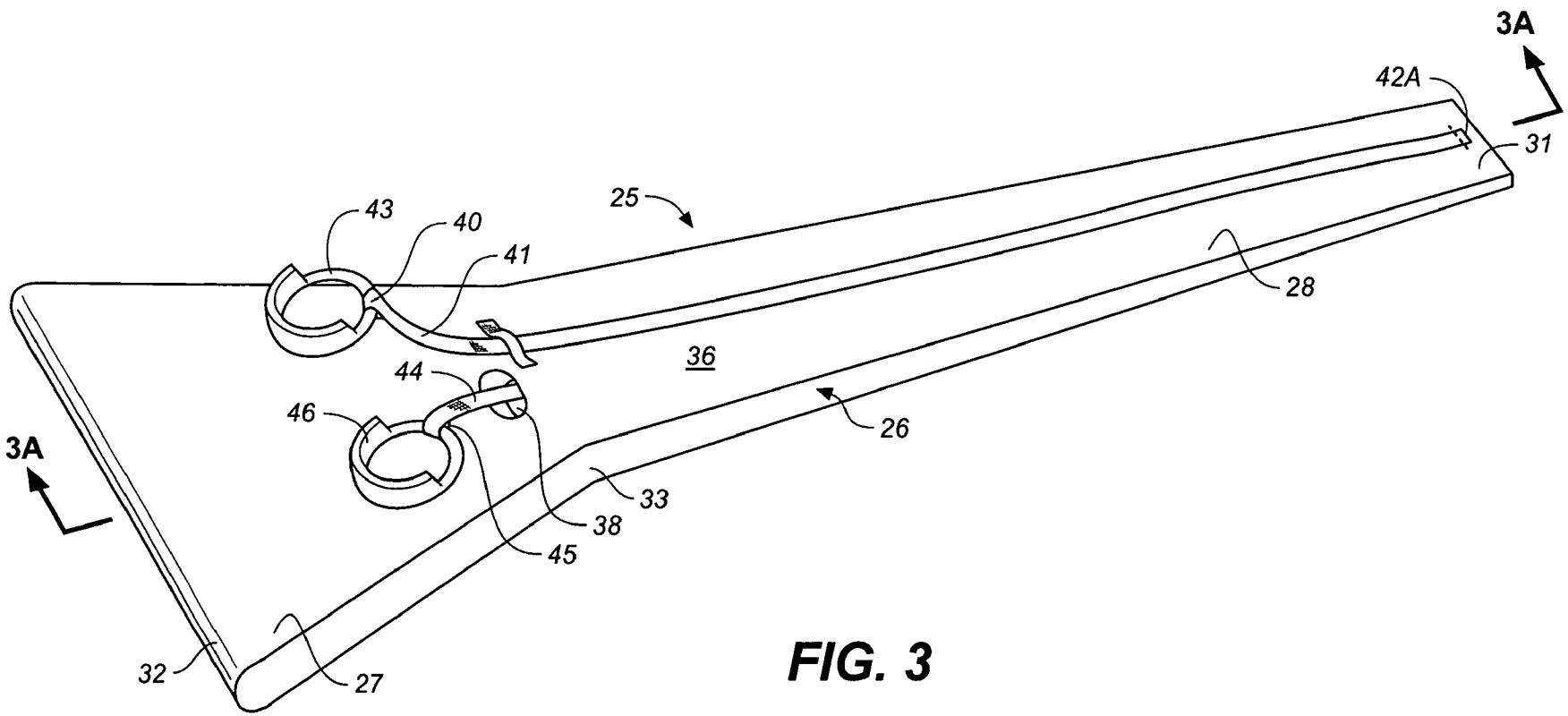
FIG. 3 is a perspective, more detailed view of the internal animator of the invention shown in FIG. 2.
Figure 3A:
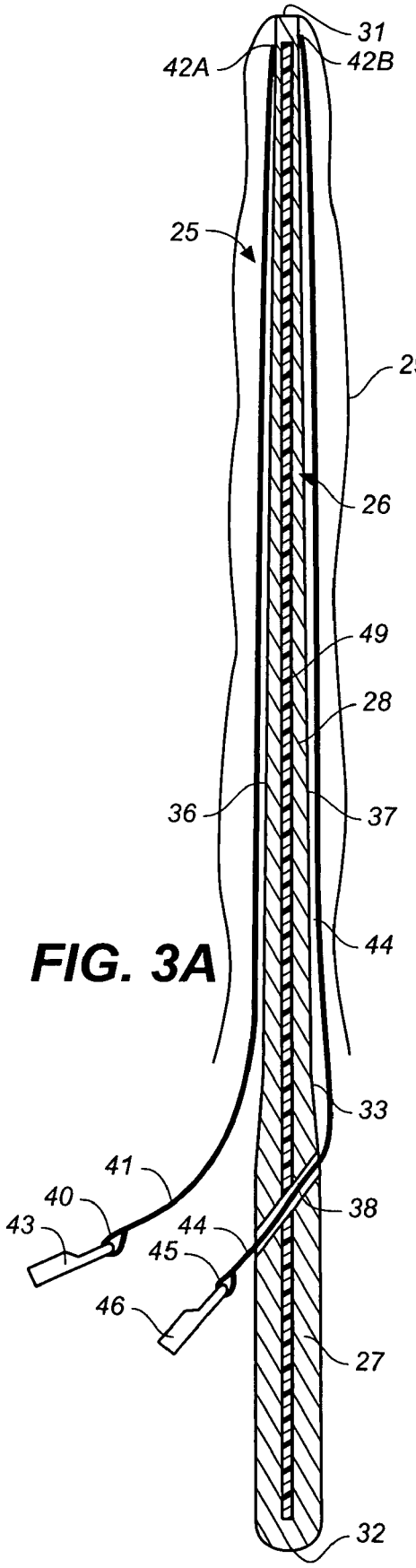
FIG. 3A is a sectional view of the animator of the invention taken along the line 3A-3A of FIG. 3 with a sheath added.

Referring to FIGS. 3 and 3A, in one embodiment of the invention, an animator 25 is formed from a generally flat, flexible, unitary (possibly molded) member 26 having a base section 27 and a flexible body section 28 terminating in a tip end 31. The base section 27 has a width that tapers from its base end 32 to the juncture 33 with the body section 28. The body section 28 can also have a slight width taper toward the tip end 31 (wider at juncture 33 than at tip end 31).

Member 26 which has a top side 36 and a generally, but not precisely, parallel bottom side 37 and an aperture 38 in the base section 27 near the juncture 33 with body section 28 can, in addition to a taper in its width, have a taper in its thickness, with the thickness being greatest at the base section 27 and least at the tip end 31. When the unitary member 26 has a width taper and a thickness taper, the flexibility of the member 26 increases along its length, with it being most flexible at tip end 31.

A first non-elastic control strap 41 extends along the top side 36 of member 26 to the tip end 31 where it is attached at 42A as by stitching or the like. A first finger-engagable device, such as pull ring 43, is attached to the free end 40 of control strap 41. A second non-elastic control strap 44 extends generally parallel to the first control strap 41 along the top side 36 of member 26, but is threaded through aperture 38 and runs along the bottom side 37 of member 26 to the tip end 31 where it is attached at 42B as by stitching or the lie. A second finger-engagable device, such as pull ring 46, is attached to the free end 45 of second control strap 44. The control straps 41 and 44 can advantageously be made of polyester ribbon.

The end 32 of base section 27 provides a structure that the thumb of a manipulating hand can press against when a finger of the hand is pulling one or both of the rings 43 and 46.

FIGS. 3 and 3A illustrate the animator 25 in the configuration assumed when neither strap 41 or 44 is being pulled. The invention includes a loose-fitting sheath cover 29 that covers the body section 28. The sheath cover 29 has been left out of FIG. 3 to reveal the path of strap 41 and its connection at 42A. The sheath cover 29 is more fully illustrated as sheath cover 85 in FIG. 4D. The loose-fitting sheath cover 29 both permits the strap 44 to pull away from body section 28, but also limits the distance therebetween. In this way, the body member can curve smoothly and naturally.

Figure 3B:
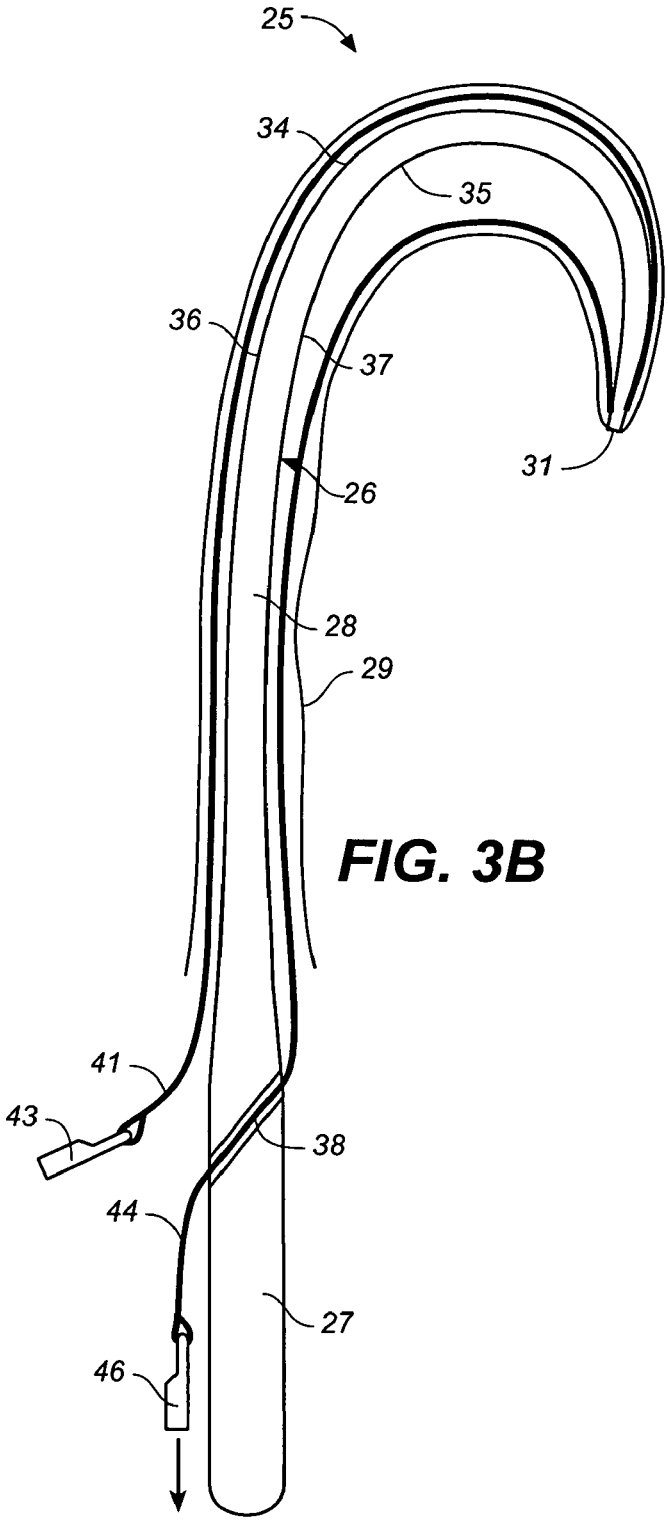
FIG. 3B is a side view of the animator of FIG. 3A with the body section shown curved as a result of one of the control straps being pulled.

Referring to FIG. 3B, when control strap 44 is pulled, the tip end 31 is drawn toward bottom side 37 of the member 26, forming a concave curve 34 in the top side 36 of member 26, and concomitantly, a convex curve 35 in bottom side 37.

Figure 3C:
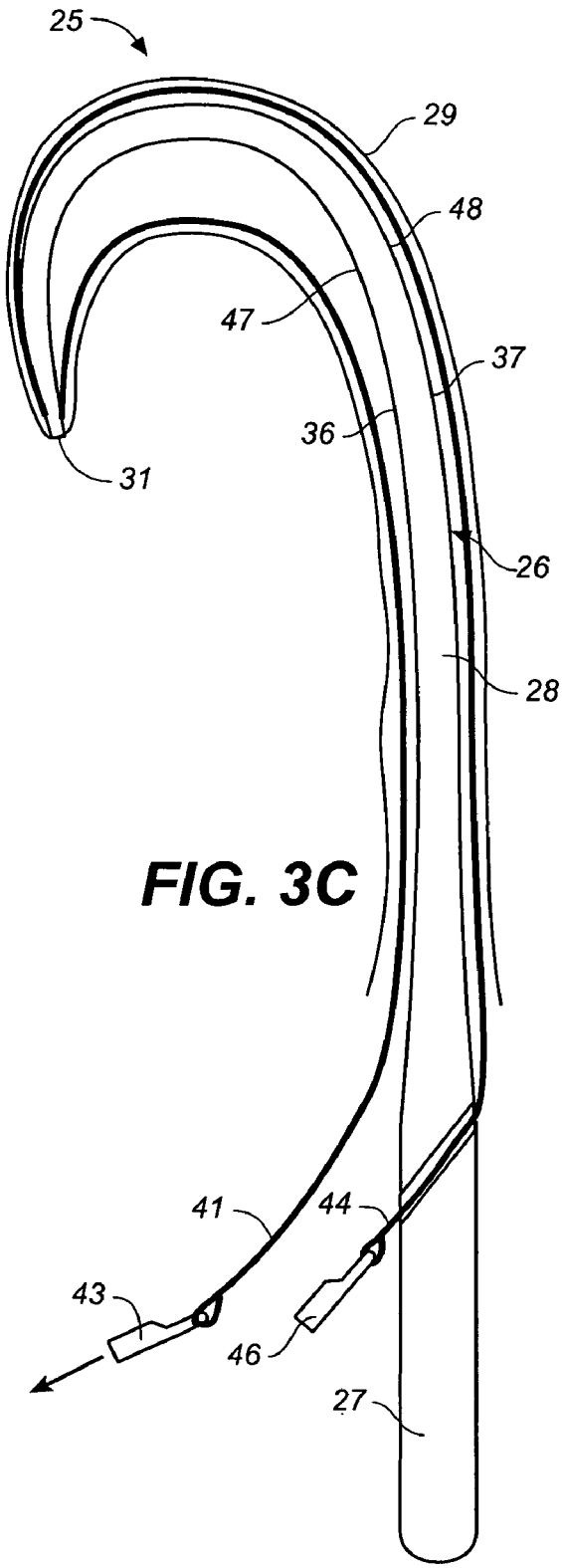
FIG. 3C is similar to FIG. 3B, but shows the body section curved as a result of pulling the other control strap.

Pulling on control strap 41 (FIG. 3C) draws tip end 31 toward the top side 36 of member 26 which produces a concave curve 47 on the top side 36 and a convex curve 48 on the bottom side 37.

Figure 3D:
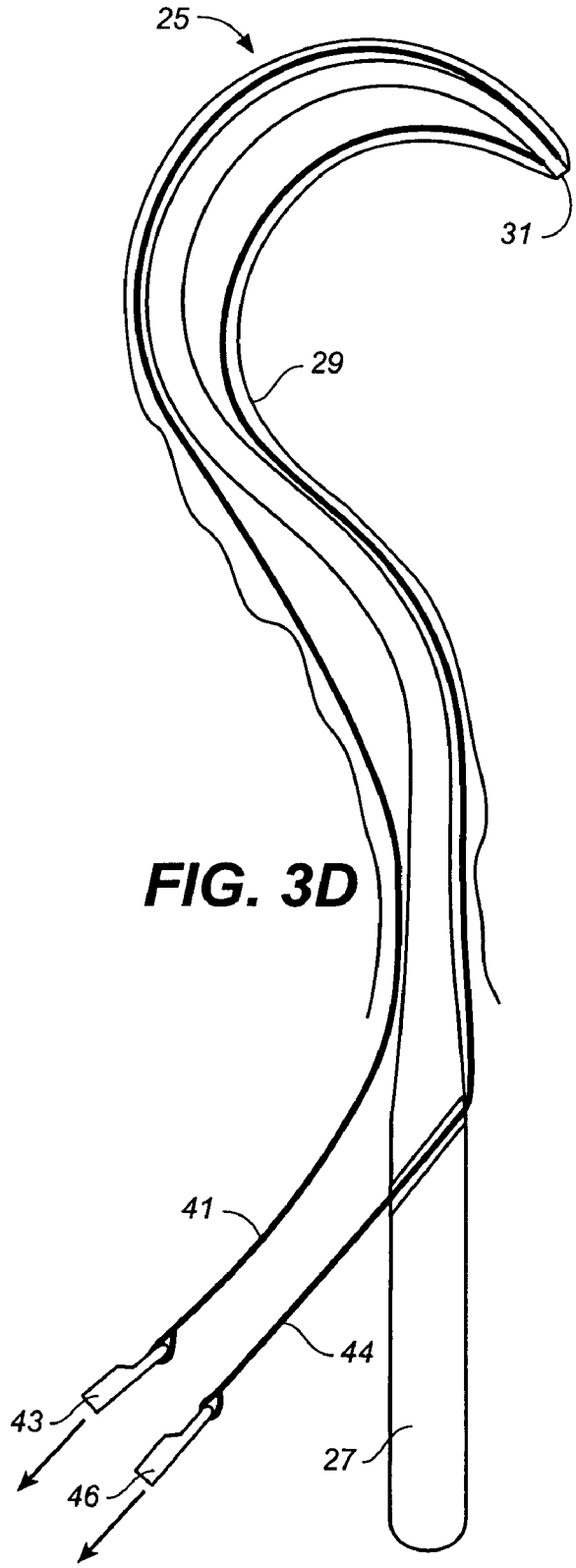
FIG. 3D is similar to FIG. 3B, but shows the body section curved as a result of pulling both control straps.

Pulling both straps 41 and 44 produces a complex curve such as that illustrated in FIG. 3D.

It will be understood by those skilled in the art that the particular curves produced by pulling on the control straps of an animator of the present invention depends on a number of factors including the construction of the animator (as more fully explained below), the particular puppet appendage in which the animator is operatively disposed and the construction of the puppet. The neck 12 and head 13 of the swan puppet 11 of FIGS. 1 and 2, for example, do not need to make a reverse curve when moving toward the swan's body 15, since that is not how a live swan moves. Thus, the construction of the animator 17 and the construction of the puppet 11 restrains the swan's neck 12 and head 13 from bending backwards (a reverse curve) as it moves towards the body 15 (see dashed lines 24) from a position of the head and neck curved forward (see dashed lines 23) such as when the swan might be feeding.

Both the width taper and thickness taper along the body section 28 help determine the shape of the curves caused by manipulating control straps 41 and 44 and can be varied to produce the shape that best emulates the movement of a particular animal that the puppet strives to emulate. For example, to emulate the movement of an elephant's trunk when putting something in its mouth, it is desirable for the body section 28 nearest tip end 31 to curl before the rest of the body section 28 curves.

When the animator 25 of the present invention is incorporated into a soft sculpture puppet, it is advantageous for its member 26 to be made from a generally soft material to retain the soft and cuddly character of the toy. A material particularly well suited to that purpose is ethylene vinyl acetate (EVA). As best seen in FIG. 3A, where desirable, to add stiffness and elasticity to the member 26, a thin sheet of flexible, elastic plastic 49 can be imbedded in the member 26 extending from the base section 27 to or near the tip end 31. In the case of the swan 11, the sheet 49 keeps the neck from drooping when not acted on by animator 17. While sheet 49 will always extend into the body section 28, whether or not it extends all the way to tip end 31 or only part way, depends on the curve characteristics and support needs required to achieve realistic movement for a particular animal puppet.

Referring to FIGS. 4A, 4B, 4C, 4D, 4E and 4F in an alternative embodiment, an animator 51 of the present invention has a laminate body structure 52 of several sheets of material including a primary body member 53 and an auxiliary body member 54. In one embodiment, a stiff but flexible elastic sheet member 55 is disposed between the primary body member 53 and the auxiliary body member 54 to increase the stiffness and overall elasticity of the laminate body structure 52.

Primary body member 53, which can be made from sheet ethylene vinyl acetate (EVA) or like material, includes a base section 56 and a flexible body section 60 terminating in a tip end 59. The base section 56 has the geometric shape of two isosceles trapezoids formed by a first trapezoid segment 61 and a second, mirror image trapezoid segment 62 which share a common base 63. A generally elliptical aperture 64 is formed near the short end of trapezoid segment 61 and a generally elliptical aperture 67 is formed near the short end of trapezoid segment 62.

Figure 4A:
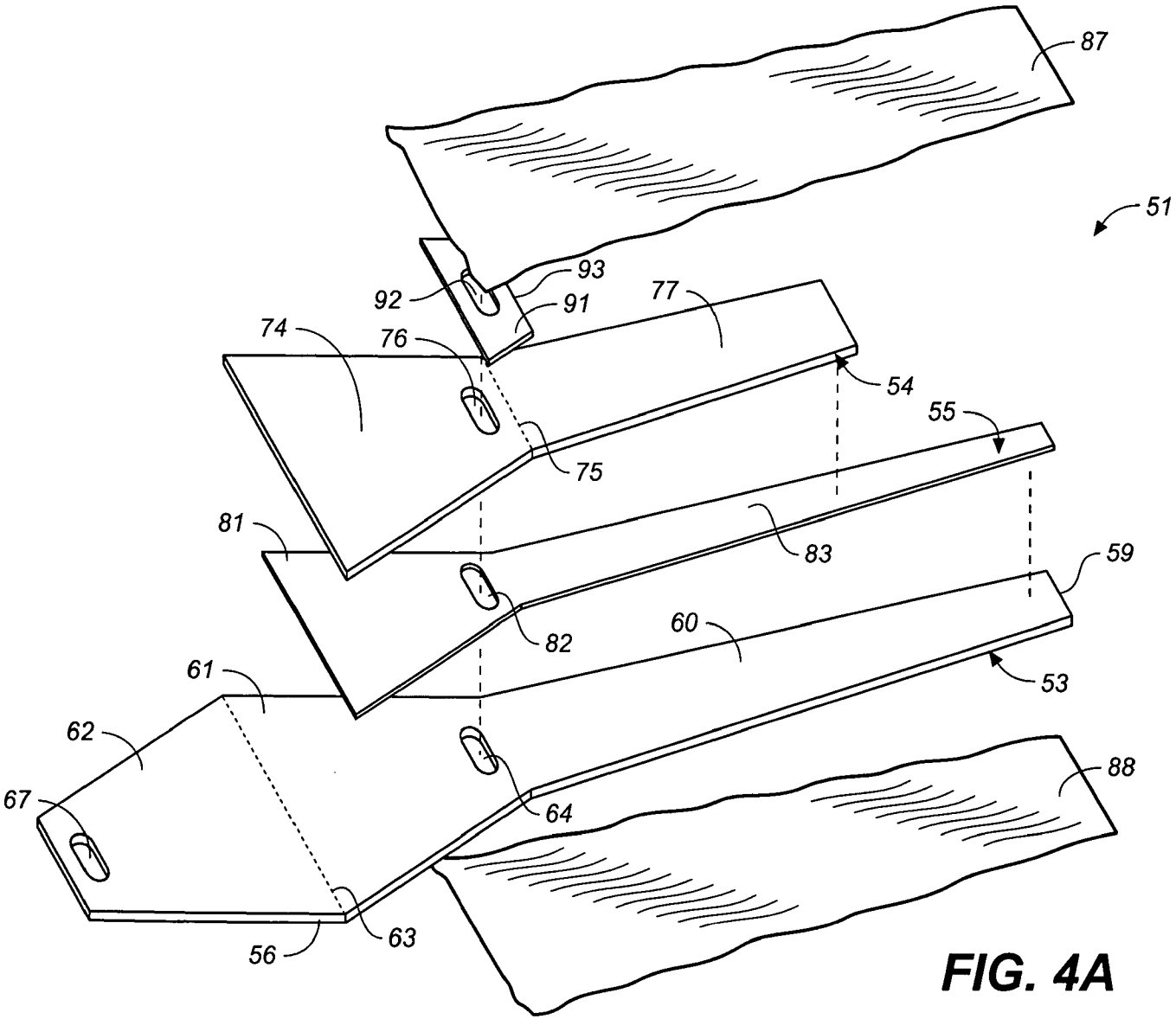
FIG. 4A is an exploded perspective view of various components of a laminate construction embodiment of the animator of the invention.
Figures 4B, 4C:
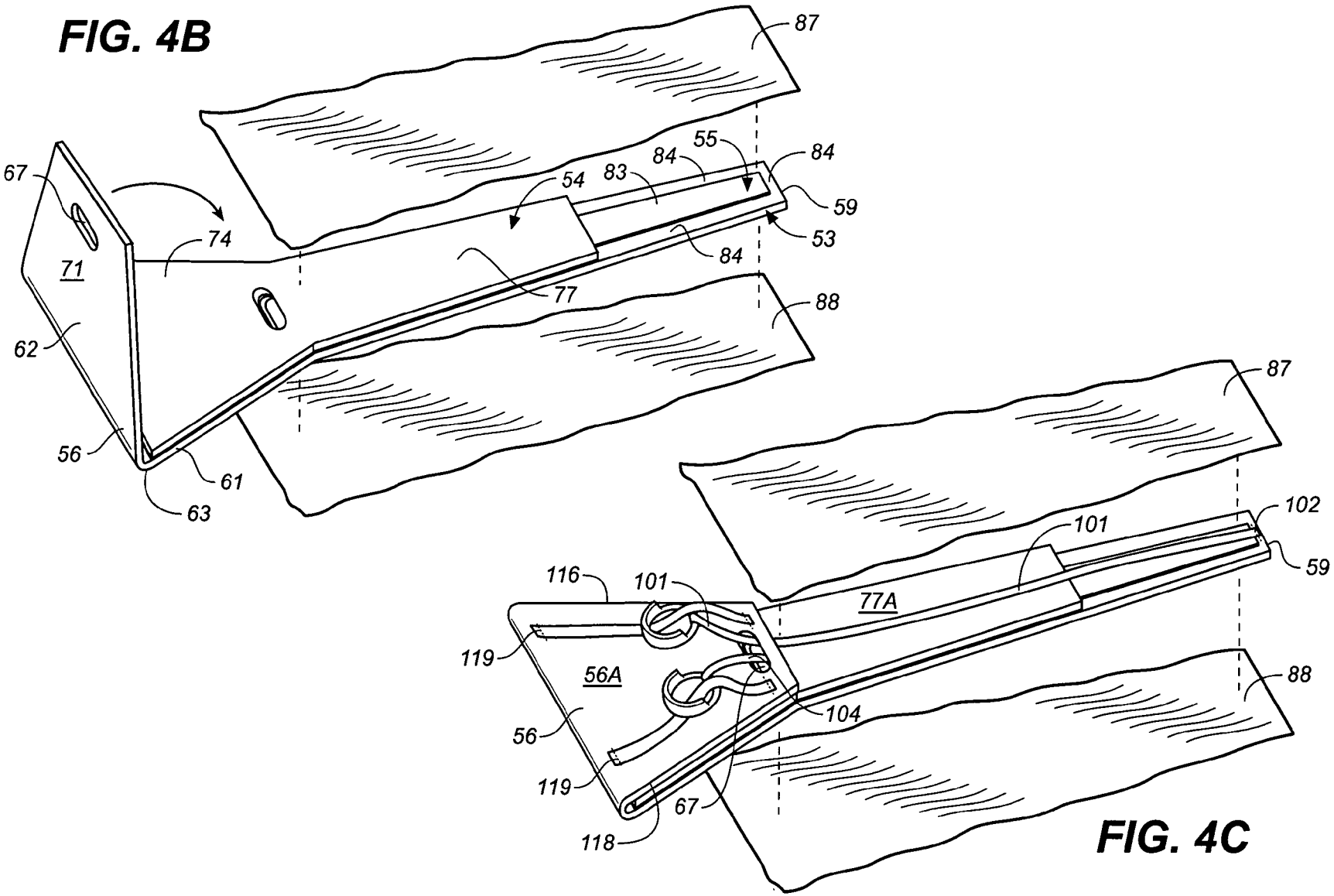
FIG. 4B is a perspective view similar to FIG. 4A with some components shown in their assembled positions.
FIG. 4C is similar to FIG. 4B showing the animator in a more advanced stage of assembly.
Figure 4D:
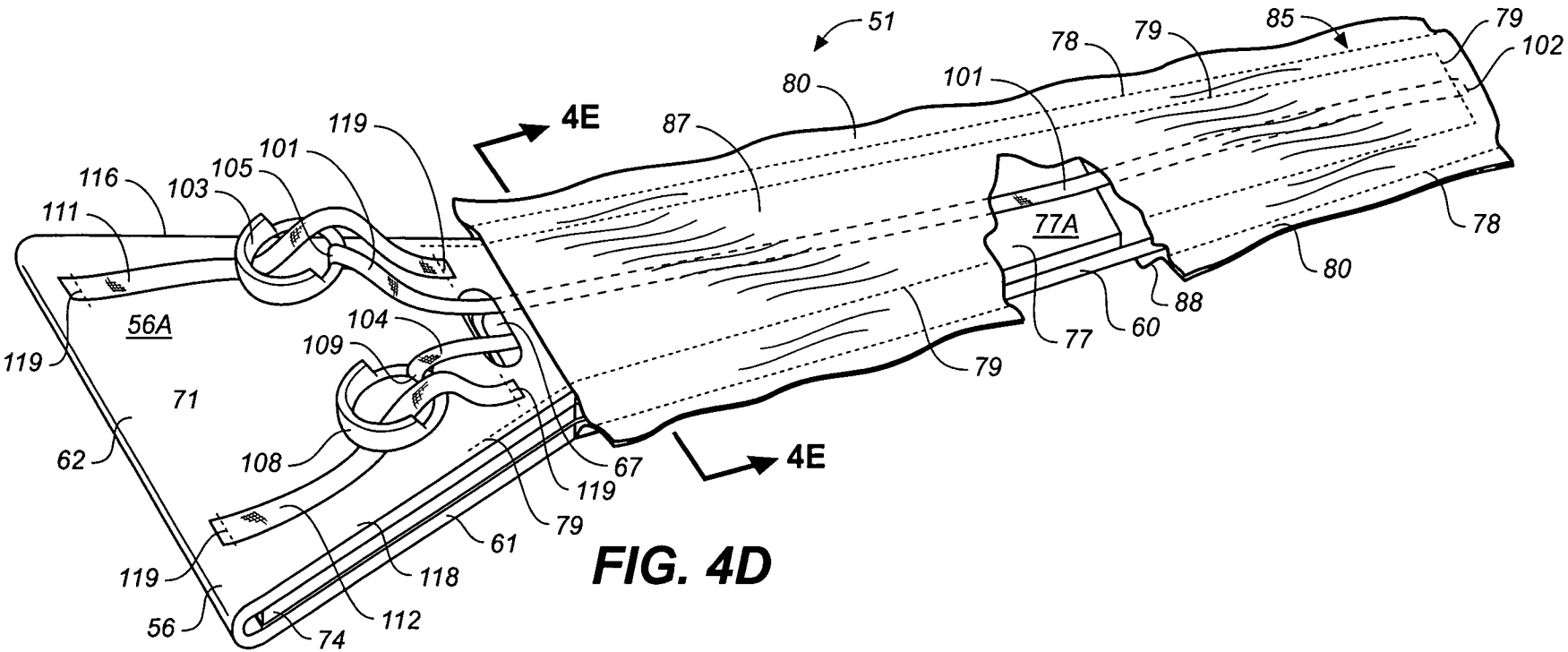
FIG. 4D is similar to FIG. 4C with the animator fully assembled and with certain internal components revealed.
Figure 4E:
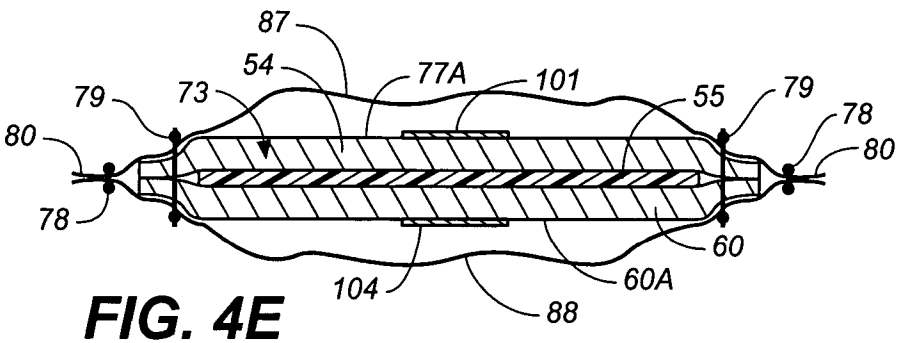
FIG. 4E is a sectional view taken along the line 4E-4E of FIG. 4D.
Figure 4F:
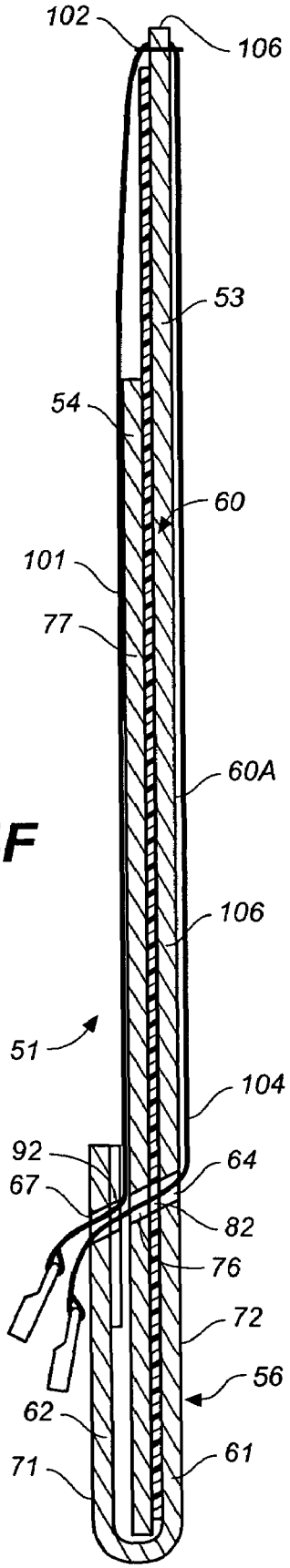
FIG. 4F is a side sectional view of the animator of FIG. 4D with the sheath not shown for purposes of clarity.
Figure 5D:
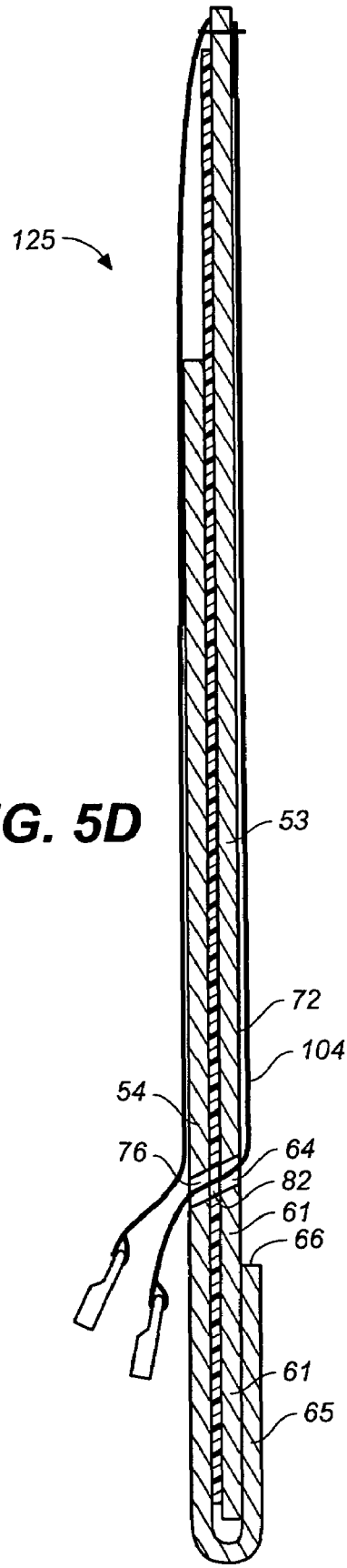
FIG. 5D is a side sectional view of the animator of FIG. 5C.
Figure 5A:
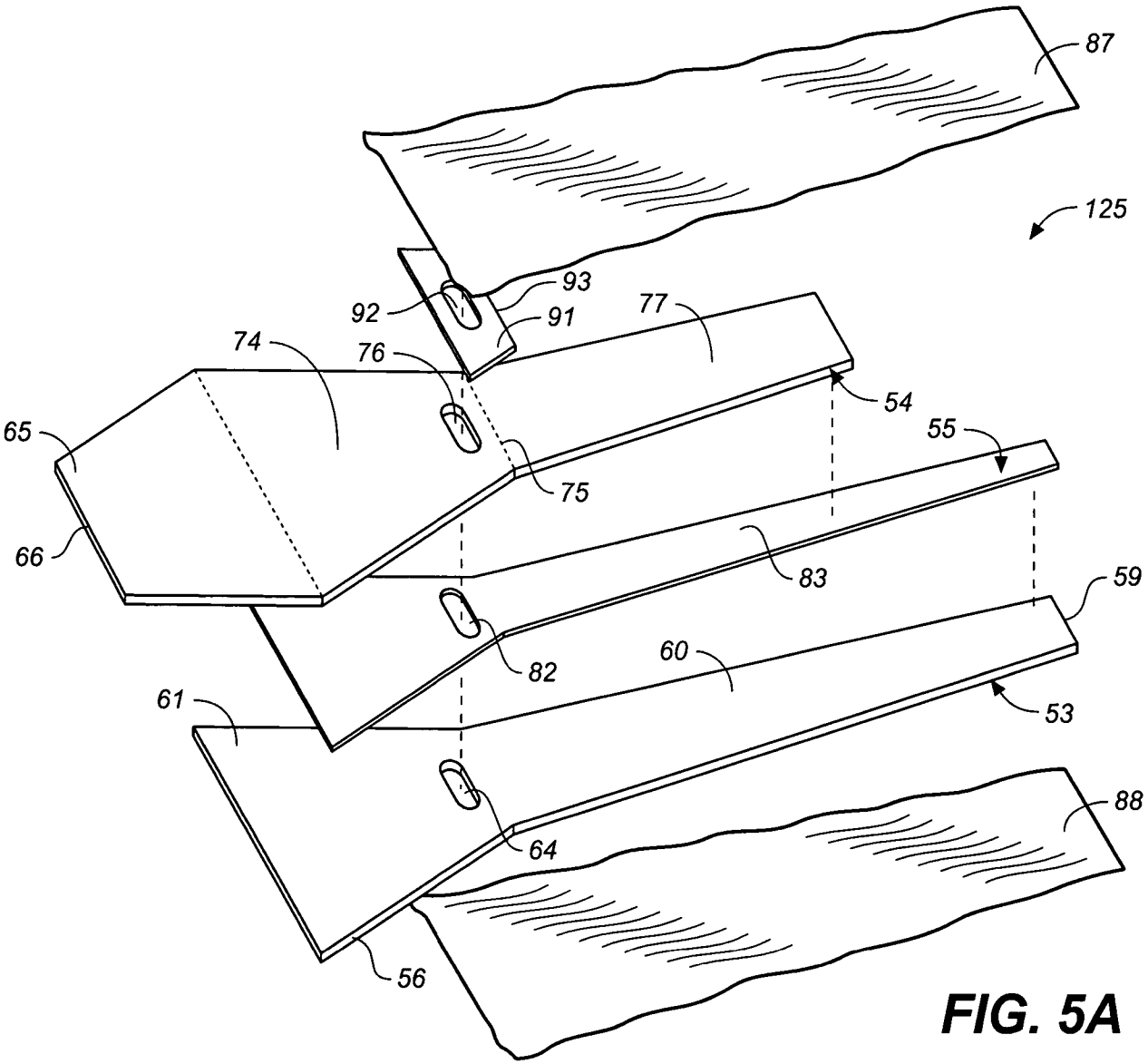
FIG. 5A is a perspective, exploded view similar to FIG. 4A, but of an alternative embodiment having a modified base section.
Figure 5B:
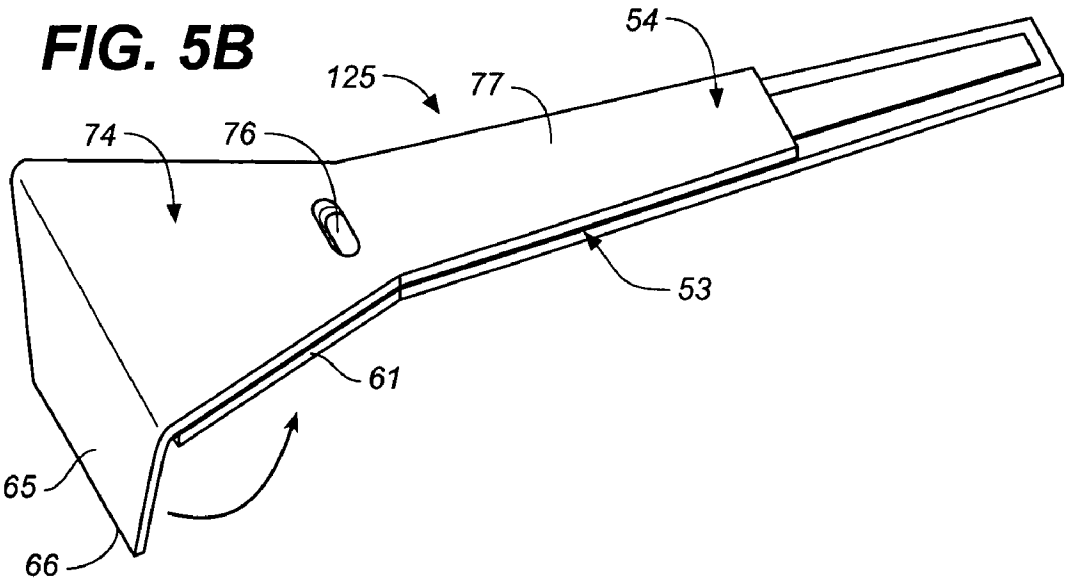
FIG. 5B is a perspective view similar to FIG. 5A showing the modified parts of the base section in a more operative relationship.
Figure 5C:
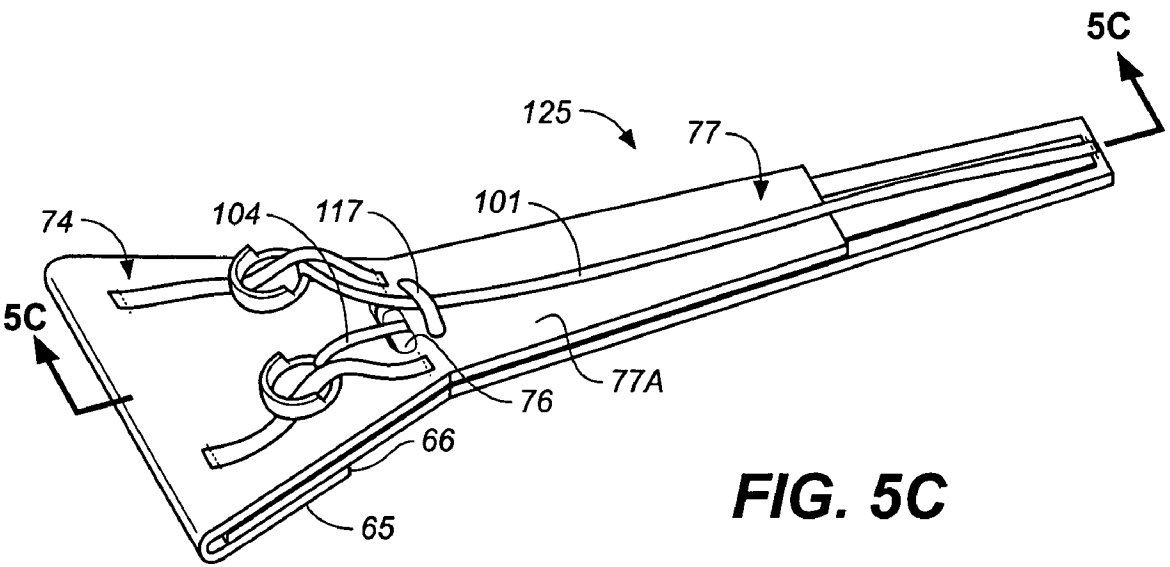
FIG. 5C is a perspective view of the animator of FIG. 5A with additional parts illustrated.

When the base trapezoid segment 62 is folded over toward base trapezoid segment 61 along the common base line 63 (see FIG. 4B), apertures 67 and 64 are aligned, forming a pass-through between the top side 71 of base section 56 and the bottom side 72 thereof (as best seen in FIG. 4F).

The auxiliary body member 54 has an isosceles trapezoid-shaped base section 74 generally matching the size and shape of isosceles trapezoid base segment 61 of primary body member 53 with a generally elliptical aperture 76 near its short end generally matching apertures 64 and 67 in base section 56. Extending from base section 74 is a body section 77 which generally matches the shape of body section 60 of primary body member 53, but which may or may not be as long, depending on the curve characteristics to be achieved. Auxiliary body member 54 can also advantageously be formed from a sheet of EVA or equivalent material.

The flexible elastic sheet member 55, preferably of plastic, has an isosceles trapezoid-shaped base section 81 generally matching the shape of isosceles trapezoid base segment 61 of primary body member 53 and a generally elliptical aperture 82 near its short end generally matching the size and shape of apertures 64 and 67 in base section 56. Extending from base section 81 is a body section 83 which generally matches the shape of body section 60 of primary body member 53, but which may or may not be as long. While the shape of elastic sheet member 55 generally matches the shape of primary body member 53, its overall dimensions are smaller, producing a margin 84 around the sides and end of primary body member 53 extending outwardly of sheet member 55 when sheet member 55 is placed on top of the primary body member 53 and its aperture 82 is aligned with aperture 67 (see FIG. 4B). Whether or not the sheet member 55 extends all the way to tip end 59, depends, once again, on the bending and stiffness requirements for a particular application.

One embodiment of the invention includes a generally rectangular-shaped aperture reinforcing member 91 (see FIG. 4A) made of a soft but durable material, such as pellon (Vilene), having a generally elliptical aperture 92 which generally matches the aperture 76 of auxiliary member 54.

A sheath cover 85 (see FIG. 4D) is formed by substantially identical panels 87 and 88 (see FIGS. 4A, B and C) of a lightweight, stretchable material such as nylon or an equivalent material. Panels 87 and 88 have the general shape of the body section 60 of primary body member 53, but are larger so that their edges extend beyond the edges of the primary body member 53 (see FIG. 4D) and are loose-fitting when attached. The sheath cover 85 has been left out of FIG. 4F for purposes of illustrative clarity.

The various pieces of the laminate body structure 52 described above are combined as follows. The flexible elastic sheet member 55 is placed onto the primary body member 53 with their respective apertures 82 and 67 aligned. While the embodiment illustrated shows the sheet member 55 extending almost all the way to the tip end 59, as mentioned above, that is not always necessary and, in some cases, it is preferred for it to only extend part way. The auxiliary member 54, which can also vary from extending all the way to tip end 59 to only part way, depending on the curve response desired, is then placed onto the sheet member 55 with the apertures 76 and 82 aligned. In an embodiment without flexible sheet member 55, auxiliary member 54 is placed directly onto primary body member 53. The length of body section 77 of auxiliary member 54 is illustrated as only extending part way to tip end 59 of primary body member 53, but, in other configurations, it can extend all the way to tip end 59. The reinforcing member 91 is sized so that its edge 93 does not extend beyond the juncture 75 between base section 74 and body section 77 of auxiliary member 54 when member 91 is placed onto auxiliary member 54 and their respective apertures 92 and 76 are aligned.

With flexible sheet 55 in place on primary body member 53, auxiliary member 54 in place on sheet 55, and reinforcing member 91 on auxiliary member 54 and all of their respective apertures aligned, the segment 62 of base section 56 of primary body member 53 is folded over toward segment 61, capturing therebetween flexible sheet 55, auxiliary member 54 and reinforcing member 91 (see FIGS. 4B and 4F). At this point, the various pieces can be joined into a unitary member by stitching along the margin 84 that surrounds the body sections of primary body member 53 and auxiliary body member 54. It is, however, advantageous to do the stitching after the sheath panels 87 and 88 are in place.

The panels 87 and 88 are placed above and below the laminated structure to loosely cover the body sections, but not the base section and, in particular, do not extend over aperture 67.

With the panels 87 and 88 in place, the various parts are secured into a unitary member by stitches 79 sewn along the sides and tip edges at the margin 84 which does not include the flexible sheet member 55. Thus secured, a combined body section 73 is formed (see FIG. 4E). The panels 87 and 88 are then stitched together at 78, outward of the edges of the body section 73 (see FIG. 4E) to encapsulate the body sections 60, 83 and 77 and form a seam allowance 80 by which the animator is attached within a puppet, such as swan 11 (see FIG. 1).

Referring particularly to FIGS. 4C, D , E and F, a first control strap 101, preferably of sturdy but lightweight, non-stretchable material, such as polyester ribbon, is disposed to extend along the top surface 56A of base section 56, through aperture 67 only and along the surface 77A of body section 77 of auxiliary member 54 to tip end 59 of primary body member 53 where it is secured as by stitching at 102. A first pull ring 103 is attached to the free end 105 of strap 101.

A second control strap 104 is disposed to extend along the top surface 56A of base section 56, through all of the apertures 67, 92, 76, 82 and 64 to and along the bottom surface 60A of the body section 60 of primary body member 53 to the tip end 59 where it, too, is secured as by stitching at 102. A second pull ring 108 is attached to the free end 109 of strap 104.

Referring primarily to FIGS. 4C and 4D, a pair of spaced-apart guide straps 111 and 112 are disposed on the upper surface 56A of segment 62 of base section 56 to keep pull rings 103 and 108, respectively, on base section 56 where they can be readily located and grasped. The guide straps 111 and 112 are best located along the edges 116 and 118 of the base section 56 and inserted through the rings 103 and 108, respectively, before being secured at their respective ends by stitching 119 or some other appropriate affixing means. In this way, the rings 103 and 108 are always on the base section 56 where they can be readily found, but do not restrict the movement of control straps 101 and 104.

Referring to FIGS. 5A, 5B, 5C and 5D, in an alternative embodiment, an animator 125 is substantially identical to the embodiment of FIG. 4A, except the base section 56 is modified by eliminating base segment 62 from primary body member 53 and adding a base segment 65 to base section 74 of auxiliary body member 54. Segment 65 is shorter than base section 74 such that when folded under toward section 74, its end 66 does not extend to aperture 76 (see in particular FIG. 5D).

The advantage of this embodiment is that second control strap 104 does not have to pass through base segment 65, thereby reducing the friction on control strap 104. This permits the elimination of aperture reinforcing member 91. To maintain strap 101 in place on body section 77, a guide strap 117 is provided on upper surface 77A of body section 77. The control strap 101 is placed through guide strap 117 and thereby maintained in position (see FIG. 5C).

Referring to FIGS. 6A, 6B, 6C and 6D, in an alternative embodiment, an animator 123 has a base section 130, a body section 134 with opposing sides 128 and 129. A first control strap 126 extends from base section 130 along side 128 to tip end 136 where it is secured at 139. A second control strap 127 extends from base section 130 along side 129 to tip end 136 where it is secured at 140. Rings 132 and 133, attached to the free ends of straps 126 and 127, respectively, are used to pull on the straps 126 and 127 to operate the animator. A soft cylindrical handle 131 is attached to base section 130. This embodiment is most appropriate for producing sideways motion such as to move the head of an alligator or the like.

Figure 6A:
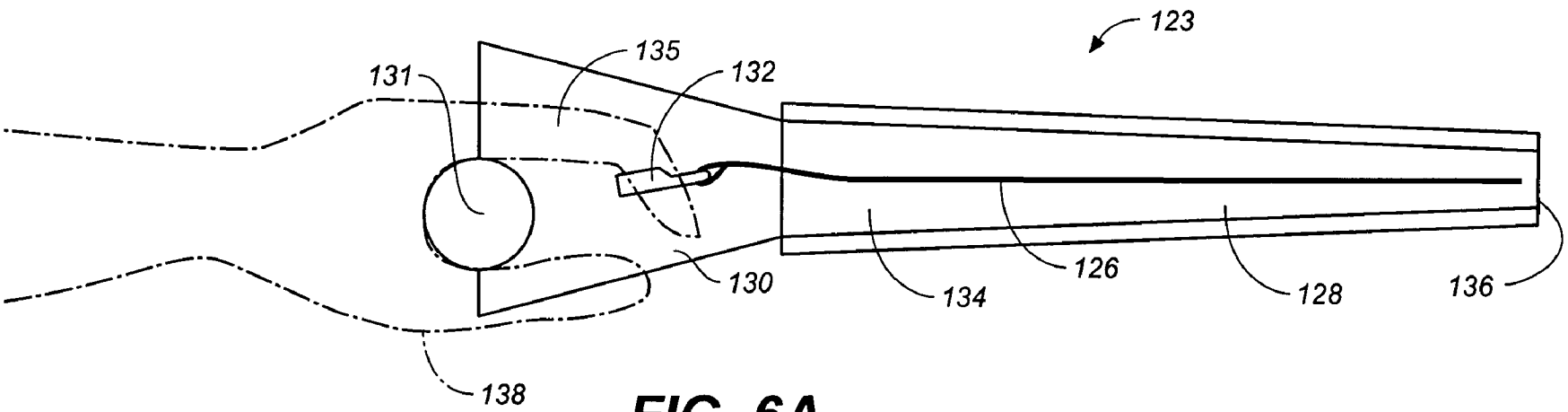
FIG. 6A is a semi-schematic side view of an alternative embodiment of the animator of the invention.
Figure 6B:
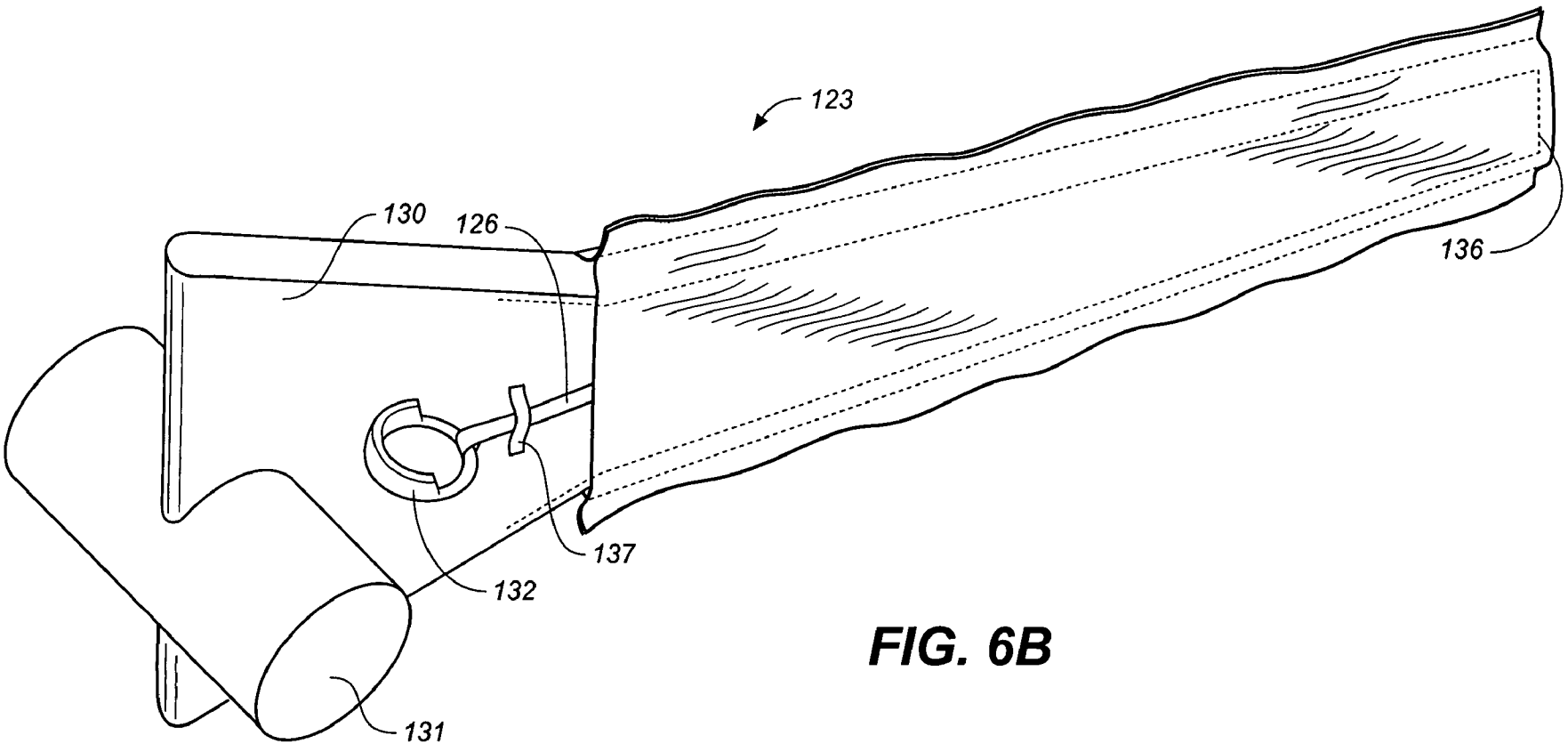
FIG. 6B is a perspective view of the animator of FIG. 6A.
Figure 6C:
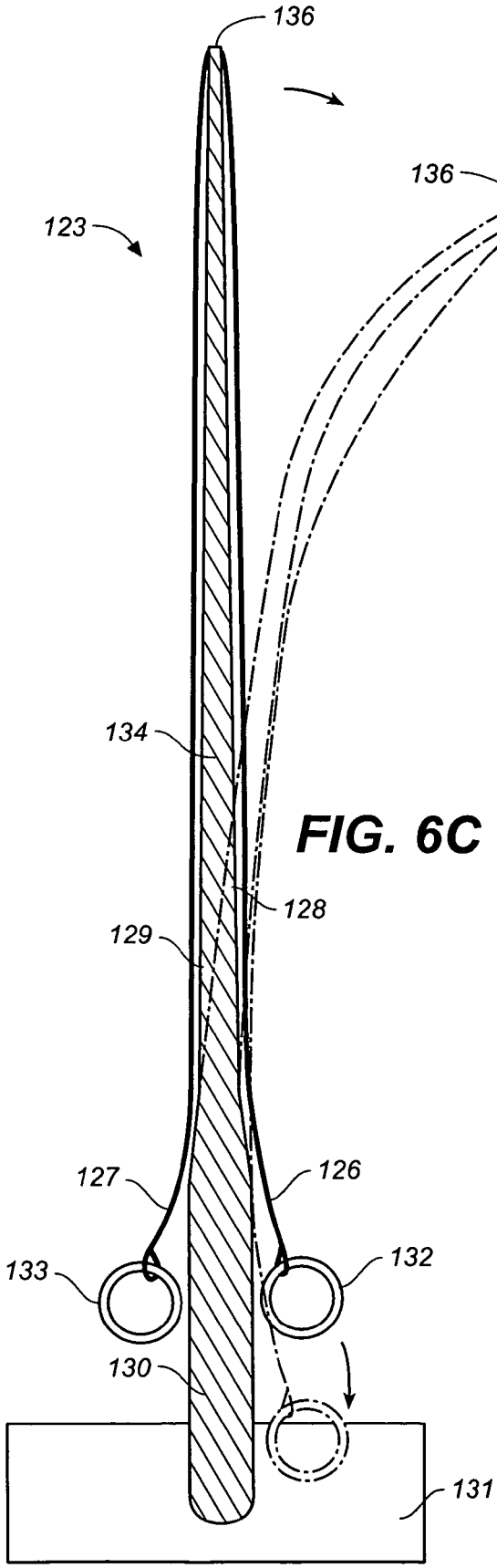
FIG. 6C is a top sectional view of the animator of FIG. 6B showing the position assumed when one of the control straps is pulled.
Figure 6D:
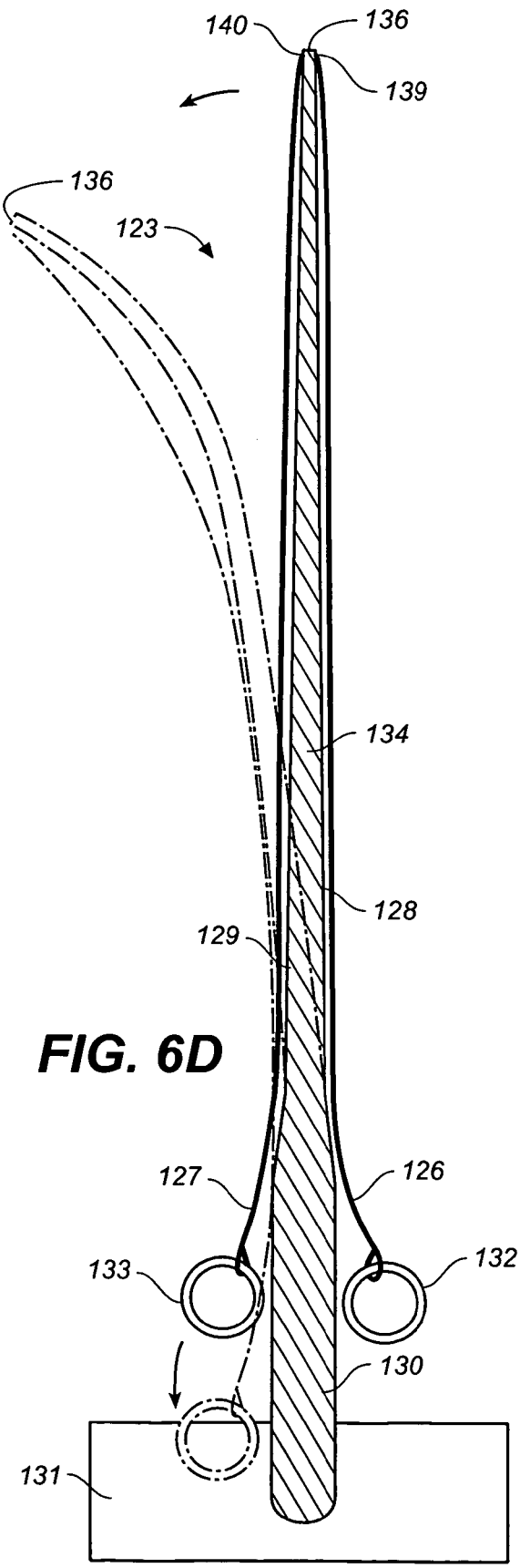
FIG. 6D is a top sectional view of the animator of FIG. 6B showing the position assumed when the other control strap is pulled.

The animator 123 is affixed in the puppet (not shown) in a generally vertical orientation, as illustrated in FIG. 6A, that automatically places the base section 130 between fingers 135 (only one of which is shown) of an operating hand 138. Fingers 135 grasp rings 132 and 133 attached to the free ends of straps 126 and 127, respectively, and by pulling thereon, cause the body section 134 to bend and move from side to side (see FIGS. 6C and 6D). The base section 130 and body section 134 of animator 123 can, in all other respects, be the same as described above in connection with the embodiments of FIGS. 3 and 5A. The significant difference is that because the control straps 126 and 127 are always on opposite sides of the animator 123, there is no need for apertures to permit one of the control straps to be threaded to the other side.

A guide strap 137 on base section 130 keeps strap 126 and ring 132 in place to be conveniently grasped. A like guide strap (not shown) is provided for strap 127 and ring 133. Alternatively, guide strap 137 can be of the type that passes through the ring 133 as shown in FIGS. 4C and 4D.

Figure 7:
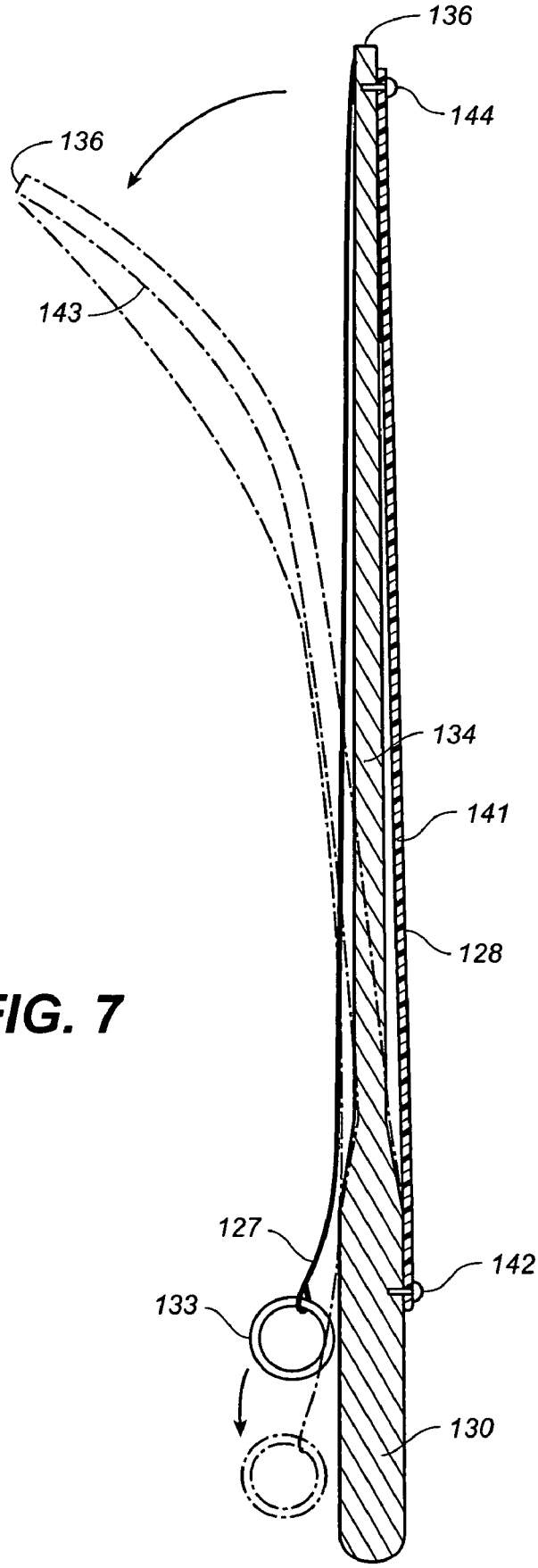
FIG. 7 is a top sectional view of an alternative embodiment similar to that of FIG. 6B, but with only a single pullable control strap.

Referring to FIG. 7, another embodiment of the invention involves a slight modification to the embodiment of FIG. 6A. Control strap 126 and its ring 132 are replaced by an elastic strap 141 which is affixed at 144 near tip end 136 and the base section 130 at 142. When ring 133 is pulled, causing the body section 134 to curve and bend (dashed lines 143), the elastic strap 141 is stretched, creating a force in a direction tending to return the body section 134 to its original position. Thus, ring 133 and strap 127 alone control the movement of the animator by pulling and releasing without the necessity of a second control strap and ring.

In all of the embodiments, two straps are disposed on opposite sides of a body section, with each strap capable of providing a force bending the body section in one direction or another with at least one strap being adapted to be controlled by a user.

It will be obvious to those skilled in the art that numerous modifications can be made in the various components described above without departing from the invention. By way of example, and without being exhaustive, the shape of the components forming the base member, the relative lengths of the components, the materials from which the components are made, the presence or absence of a flexible sheet member, the existence, shape and size of the apertures, the use of a solid structure or a laminate structure, the presence and degrees of taper, and the presence or absence of a sheath, are all matters of choice that are within the scope of the invention. As such, it is intended that the present invention only be limited by the terms of the appended claims.

What is claimed is:

1. A puppet animator comprising:

a generally flat, unitary, elongate flexible body section having a first external side and an opposing second external side and terminating in a tip end;

a first control strap having two ends and extending along said first external side of said body section to said tip end where one of said first strap ends is affixed, while the other of said first strap ends is free; and a second control strap having two ends and extending along said second external side of said body section to said tip end where one of its ends is affixed; whereby a pulling force on said first control strap causes said flexible body section to bend in one direction and a pulling force on said second control strap causes said flexible body section to bend in a second direction;

and a first pull ring attached to the free end of said first control strap whereby a pulling force can be applied to said first strap by pulling on said pull ring.

2. The puppet animator of claim 1 wherein said second control strap is elastic and is affixed at both of its ends whereby it is stretched when said body section is caused to bend by a pulling force on said pull ring of said first control strap.

3. The puppet animator of claim 1 wherein said second control strap has a free end and further comprising:

a second pull ring attached at the free end of said second control strap whereby a pulling force can be applied to said first and second straps separately or together by pulling on said first and second rings.

4. The puppet animator of claim 1 further comprising:

a base section that is contiguous with and extends from said elongate flexible body section, said base section having a first external side generally aligned with said first external side of said body section and a second external side generally aligned with said second external side of said body section; and wherein said first control strap and said second control strap are disposed on at least one external side of said base section.

5. The puppet animator of claim 4 further comprising:

a first guide strap disposed on said base section maintaining said first control strap in position on said base section; and a second guide strap disposed on said base section maintaining said second control strap in position on said base section.

6. The puppet animator of claim 5 wherein each of said guide straps passes through the ring attached to its respective control strap.

7. The puppet animator of claim 1 further comprising:

a base section from which said elongate flexible body section extends, said base section having a first side generally aligned with said first side of said body section and a second side generally aligned with said second side of said body section;

an aperture in said base section providing a passage from said first side to said second side thereof; and wherein said first control strap is disposed on said first side of said base section and said first side of said body section and said second control strap is disposed on said first side of said base section, and through said aperture to said second side of said body section.

8. The puppet animator of claim 7 wherein said second control strap has a free end and further comprising:

a second pull ring attached to the free end of said second control strap:

whereby a pulling force can be applied to said first and second control straps by pulling on said first and second pull rings;

a first guide strap disposed on said first side of paid base section passing through said first pull ring attached to said first control strap; and a second guide strap spaced apart from said first guide strap and disposed on said first side of said base section passing through said second pull ring attached to said second control strap whereby said first and second pull rings are maintained on said first side of said base section.

9. The puppet animator of claim 7 wherein said body section is a unitary member.

10. The puppet animator of claim 9 further comprising:

an elongate flexible, plastic sheet member embedded in said body section.

11. The puppet animator of claim 10 wherein said elongate flexible sheet member does not extend to said tip end.

12. The puppet animator of claim 11 wherein said body section is further described as having a width wherein said width tapers toward said tip end.

13. The puppet animator of claim 7 further comprising:

a stretchable sheath enclosing said body section and said control straps disposed thereon.

14. The puppet animator of claim 13 wherein said sheath has a seam allowance by which said animator can be attached to a puppet.

15. The puppet animator of claim 1 further comprising:

a stretchable sheath enclosing said body section and said control straps disposed thereon.

16. The puppet animator of claim 15 wherein said sheath has a seam allowance by which said animator can be attached to a puppet.

17. The puppet animator of claim 1 wherein said elongate flexible body section has a laminate structure including:

a flexible primary body member extending the length of said body section to its tip end; and an flexible auxiliary body member extending along said primary body member no further than the tip end of said body section.

18. The puppet animator of claim 17 wherein said auxiliary body member extends along said primary body member to a point short of the tip end of said body section.

19. The puppet animator of claim 17 wherein said laminate structure further includes:

a flexible elastic sheet member disposed between said primary body member and said auxiliary body member and extending to a point short of the tip end of said body section.

20. The puppet animator of claim 19 wherein said base section is a laminate structure including extensions of said primary body member, said auxiliary body member and said flexible elastic sheet member.

21. The puppet animator of claim 20 further comprising:

a stretchable sheath enclosing said body section and said control straps disposed thereon.

22. The puppet animator of claim 21 wherein said sheath has a seam allowance by which said animator can be attached to a puppet.

23. The animator of claim 20 wherein said primary body member and said auxiliary body member are formed from sheets of ethylene vinyl acetate.

24. The puppet animator of claim 17 wherein said base section is a laminate structure including extensions of said primary body member, and said auxiliary body member.

25. The puppet animator of claim 24 further comprising:

a stretchable sheath enclosing said body section and said control straps disposed thereon.

26. The puppet animator of claim 25 wherein said sheath has a seam allowance by which said animator can be attached to a puppet.

27. The animator of claim 17 wherein said primary body member and said auxiliary body member are formed from sheets of ethylene vinyl acetate.

28. A soft sculpture puppet having disposed therein any of the animators of any one of claims 1-4, 5-19, or 20.

29. The puppet animator of claim 1 further comprising:

a base section from which said elongate flexible body section extends, said base section having a first, side generally aligned with said first side of said body section and a second side generally aligned with said second side of said body section; and wherein said first control strap is disposed on said first side of said base section and said second control strap is disposed on said first side of said base section.

30. The puppet animator of claim 1 further comprising:

a base section that is contiguous with and extends from said elongate flexible body section, said base section having a first side generally aligned with said first side of said body section and a second side generally aligned with said second side of said body section; and wherein said first control strap is disposed on said first side of said base section and said second control strap is disposed on said second side of said base section.

31. An animated soft sculpture puppet having a body with an internal chamber sized to receive a person's hand and an elongated member extending from the body comprising:

a flexible elongated animator having a base section, and a body section terminating in a tip end, wherein at least a portion of said base section is disposed within the internal chamber and said body section extends into the elongated member; and hand-manipulable controls attached to said animator and accessible from the internal chamber by which said animator is made to bend and wherein said hand-manipulable controls include at least one strap having an end disposed in the internal chamber and attached to a ring.

32. The animated soft sculpture puppet of claim 31 wherein said hand manipulable controls include a pair of straps each having an end disposed in the internal chamber and attached to a ring.

33. The animated soft sculpture puppet of claim 32 wherein said flexible elongated animator has a top side and a generally parallel bottom side and one of said control straps is disposed along the top side and the other along the bottom side and both said straps are attached at said tip end.

34. The animated soft sculpture puppet of claim 33 further comprising:

a stretchable sheath encasing a portion of said animator including said tip end and including portions of said straps.

35. The animated soft sculpture puppet of claim 34 further comprising:

a seam allowance on said sheath by which said animator is attached within the soft sculpture puppet.

36. The animated soft sculpture puppet of claim 34 wherein said animator is a laminated structure including sheets of ethylene vinyl acetate.

* * * * *